US007950328B2

(12) United States Patent
Howerton

(10) Patent No.: US 7,950,328 B2
(45) Date of Patent: May 31, 2011

(54) BLAST HOLE LINER

(76) Inventor: Dave Howerton, Paducah, KY (US)

( * ) Notice: Subject to any disclaimer, the term of this patent is extended or adjusted under 35 U.S.C. 154(b) by 0 days.

(21) Appl. No.: 12/001,200

(22) Filed: Dec. 10, 2007

(65) Prior Publication Data

US 2009/0145322 A1 Jun. 11, 2009

Related U.S. Application Data

(60) Provisional application No. 60/873,619, filed on Dec. 7, 2006.

(51) Int. Cl.
*F42B 3/00* (2006.01)

(52) U.S. Cl. ..... 102/319; 102/313; 102/331; 102/332; 102/323

(58) Field of Classification Search ..... 102/313
See application file for complete search history.

(56) References Cited

U.S. PATENT DOCUMENTS

| | | | | |
|---|---|---|---|---|
| 2,745,346 | A | | 5/1956 | Aitchison et al. |
| 2,920,523 | A | | 1/1960 | Barco et al. |
| 3,049,079 | A | | 8/1962 | Eilo |
| 3,687,075 | A | | 8/1972 | Fritz |
| 3,696,703 | A | | 10/1972 | Fox |
| 3,782,283 | A | | 1/1974 | Lingens et al. |
| 4,248,303 | A | | 2/1981 | Charpentier |
| 4,382,410 | A | * | 5/1983 | Bowling et al. ..... 102/310 |
| 4,422,382 | A | | 12/1983 | Marz |
| 4,513,665 | A | | 4/1985 | Ricketts et al. |
| 4,757,764 | A | * | 7/1988 | Thureson et al. ..... 102/312 |
| 5,005,641 | A | * | 4/1991 | Mohaupt ..... 166/63 |
| 5,259,316 | A | | 11/1993 | Nelson et al. |
| 6,523,474 | B2 | | 2/2003 | Parrott et al. |
| 6,564,686 | B1 | * | 5/2003 | Keeling et al. ..... 86/20.15 |
| 6,631,684 | B2 | | 10/2003 | Kang |
| 6,722,251 | B2 | * | 4/2004 | Keeling et al. ..... 86/20.15 |
| 6,941,871 | B2 | | 9/2005 | Mauldin |
| 2006/0027123 | A1 | | 2/2006 | Van Dyk et al. |

* cited by examiner

*Primary Examiner* — Michael Carone
*Assistant Examiner* — Samir Abdosh
(74) *Attorney, Agent, or Firm* — Carrithers Law Office, PLLC; David W. Carrithers

(57) ABSTRACT

A borehole liner comprising a continuous length of polymer tubing of alternating diameters forming undulations sized for creating undulations in the liner to optimize the annular air gap alternating with full bore hole diameter loads of explosive to effectively reduce overall explosives consumption by 1-20%. Explosive charge weights can be modified to meet the users needs without introducing inert materials or other more labor intensive alternative.

9 Claims, 3 Drawing Sheets

BLAST HOLE LINER

CROSS REFERENCE TO RELATED APPLICATIONS

This application claims priority from Provisional Application Ser. No. 60/873,619 filed on Dec. 7, 2006 which is incorporated by reference herein in their entirety. Reference to documents made in the specification is intended to result in such patents or literature cited are expressly incorporated herein by reference, including any patents or other literature references cited within such documents as if fully set forth in this specification.

BACKGROUND OF THE INVENTION

1. Field of the Invention

The invention relates to the field of explosive blasting techniques and more particularly, but not by way of limitation, to the use of multiple detonation points in a chain of explosives to reduce burn time and the use of an air gap method and apparatus to reduce the quantity of explosive materials using an undulated plastic liner that is loaded once the liner is in place in a generally cylindrical (i.e. straight-sided) borehole or borehole having irregularities.

2. Description of the Prior Art

In the practice of standard blasting methods, elongated boreholes are drilled into a rock formation which is to be removed. The borehole is then completely filled with explosives including solid, liquid or gelatin chemical compounds, which upon detonation, are converted to intensely hot gaseous compounds that, because of confinement within the borehole, exert tremendous destructive forces against the confining rock which typically yields to these forces and is reduced to rubble.

Prior art is limited by the detonation characteristics of blasting agents. Specifically, the critical diameter necessary for sustaining full order detonation limits the application of prior techniques and products. Methods such as plugging or gapping the powder column (Fitzgibbons, Kang) and Axial Air Gapping (Kang, Robert) are limited in that the method of reducing the quantity of explosives risks either a low order deflagration or a complete shutdown of the detonation.

According to prior art the gap method utilizes sympathetic detonation, the ability of the explosion to jump the gap and re-ignite the adjacent charge or creates an internal gap within the column, leaving enough explosives surrounding the void to sustain detonation. In practical applications this latter limit has not been tested since the Axial Air Gap is less than the proven limits of the sympathetic gap.

In the past, protection against water attack has been provided by containing the water-sensitive blasting agent in metal or other water-proof containers or in plastic bags which may then be lowered into the borehole for detonation. More recently, the blasting industry has developed the practice of using tubular plastic liners or sleeves; thereafter the blasting agent is poured or pumped into the lined hole. Such liners provide additionally prevent the loss of blasting agent. There are, however, certain difficulties and problems associated with the use of plastic borehole liners. Generally, the liner employed comprises a thin-wall material so that it may conform to any irregularities within the borehole and so provide a full compaction of the contained explosive to fill the interstices in the wall of the hole.

SUMMARY OF THE INVENTION

A blast hole liner system provides multiple benefits over previous inventions. Prior art is limited by the detonation characteristics of blasting agents. Specifically, the critical diameter necessary for sustaining full order detonation limits the application of prior techniques and products. Methods such as plugging or gapping the powder column and Axial Air Gapping are limited in that the method of reducing the quantity of explosives risks either a low order deflagration or a complete shutdown of the detonation. This invention uses historically proven principles of explosive science by maintaining continuous solid columns of explosives in excess of the limits of the critical diameters for ANFO and ANFO-Emulsion blends. The critical minimum diameter for ANFO is 3 inches. The blast hole liner system is utilized primarily in hole greater than 5 inches in diameter reducing total explosives pounds per hole by 10-20% but only affecting any linear portion of the explosive column by 20% or less. The gap method reduces column loads by 10% in affected areas while the annular gap method reduces column loads in the affected area by from 22 to 40%. Larger diameter holes in the 7 to 12 inch range, have much greater flexibility in that the overall reduction can be attained in fewer feet or averaged over the length of the entire column. Typically the blast hole liner system will allow the individual blaster to custom order the column reduction to suit the specific needs regarding rock strata, economic goals or environmental concerns.

This process can be described as annular air gapping in solid columns or bulk loaded explosives. Traditionally, bulk blasting agent was an oxygen balance mixture or ammonium nitrate and #2 diesel fuel. It was found that this combination produced satisfactory results in most surface mining applications. Additionally ANFO had this advantage of being somewhat cost effective compound to other explosives. A problem, however, with ANFO is its lack of water resistance. One method consists of lining the bore hole with a continuous plastic tube or liner inserted prior to loading ANFO to prevent moisture exposure. This method meets money and industry needs for water resistance in ANFO blasting. Different versions have been developed to either replace, enhance or protect ANFO from moisture.

Another issue in blasting with ANFO is the physical limits created by this relationship or bore hole diameter and product density. These two factors combined to establish this pounds of explosives which must be loaded per foot of bore hole. Due to the restrictive capital costs of the drilling equipment, mining operations generally do not have the option of having multiple sizes of drill holes on for some job. The present invention addresses this water resistance issue and proves a cost effective and versatile alternative to solid column loading of bulk explosives. The borehole liner creates an annular air gap alternating with full bore hole diameter loads to effectively reduce overall explosives consumption by 1-20%. Explosive charge weights can be modified to meet the users needs without introducing inert materials or other more labor intensive altenators. The borehole liner consists of a poly tubing of alternating diameters in preplanned lengths. This engineered placement of the alternating charge weight ensures that the blast has the maximum of control in designing the blast and thus controlling both the blast result and cost.

It is an object of the present invention to provide an axial air gap of a specificed volume within the borehole displacing explosive within borehole while maintaining a continuous column of blasting agent.

It is an object of the present invention to provide an economic sleeve which reduces the amount of explosives necessary to blast a bore hole as compared to conventional bore holes without using spacing to optimize powder use.

It is an object of the present invention to provide an economic sleeve which reduces the NOX emissions associated with blasting.

It is an object of the present invention to provide an economic sleeve which provides wet hole protection for ANFO.

It is an object of the present invention to provide an economic sleeve which seals and bridges cracks and conserves explosives.

It is an object of the present invention to provide an economic sleeve which reduces the vibration and provides a means for air blast control.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
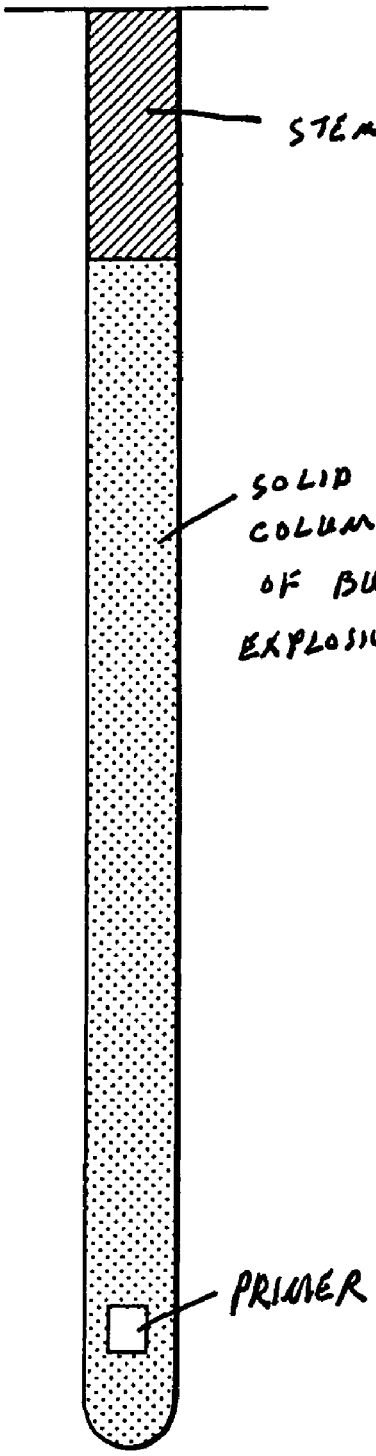
FIG. 1 PRIOR ART
FIG. 1 is a sectional side view of a typical borehole conventionally loaded with explosives depicting a solid column fulled with bulk explosives.
Figure 2:
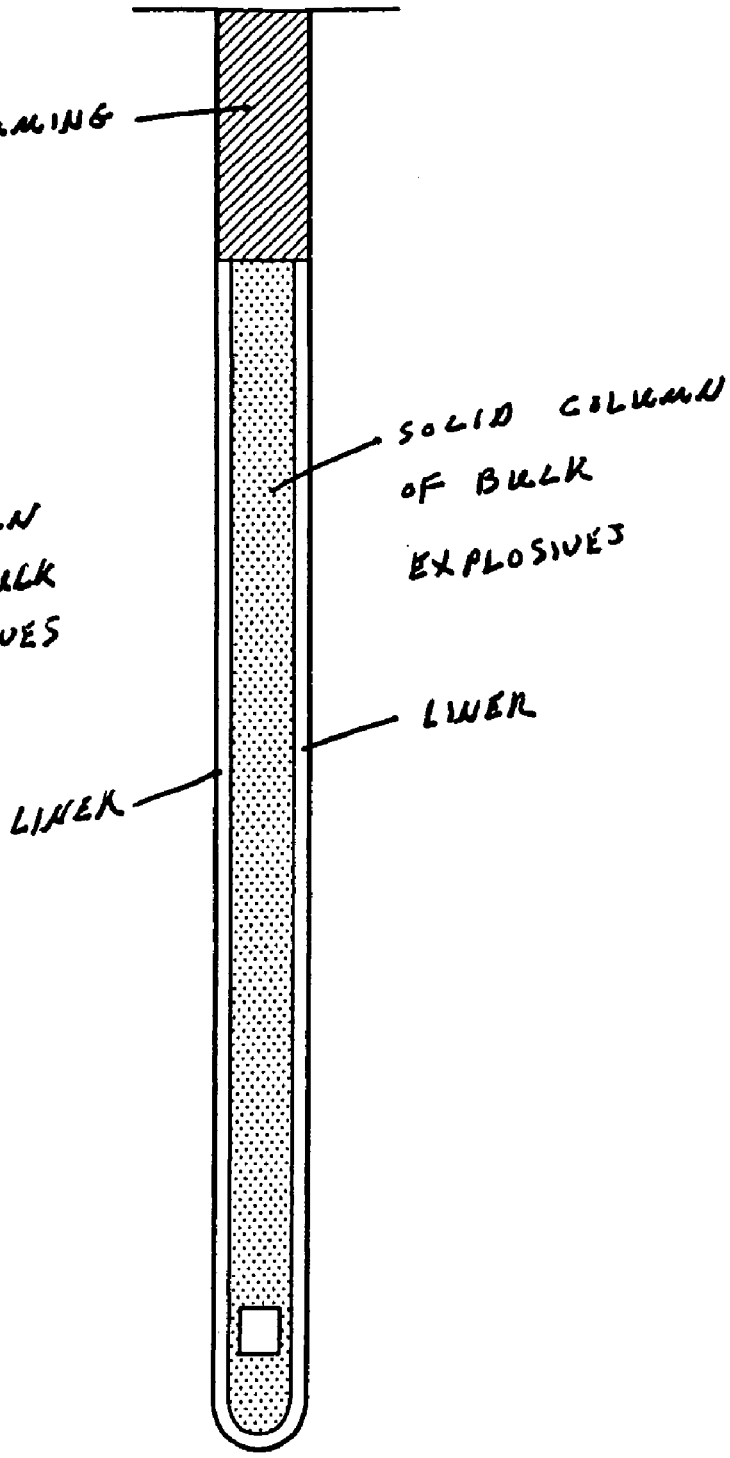
FIG. 2 PRIOR ART
FIG. 2 is a sectional side view of a lined borehole conventionally loaded with explosives depicting a liner the same size or slightly smaller than the bore hole without changing the charge weight of the explosive;.
Figure 3:
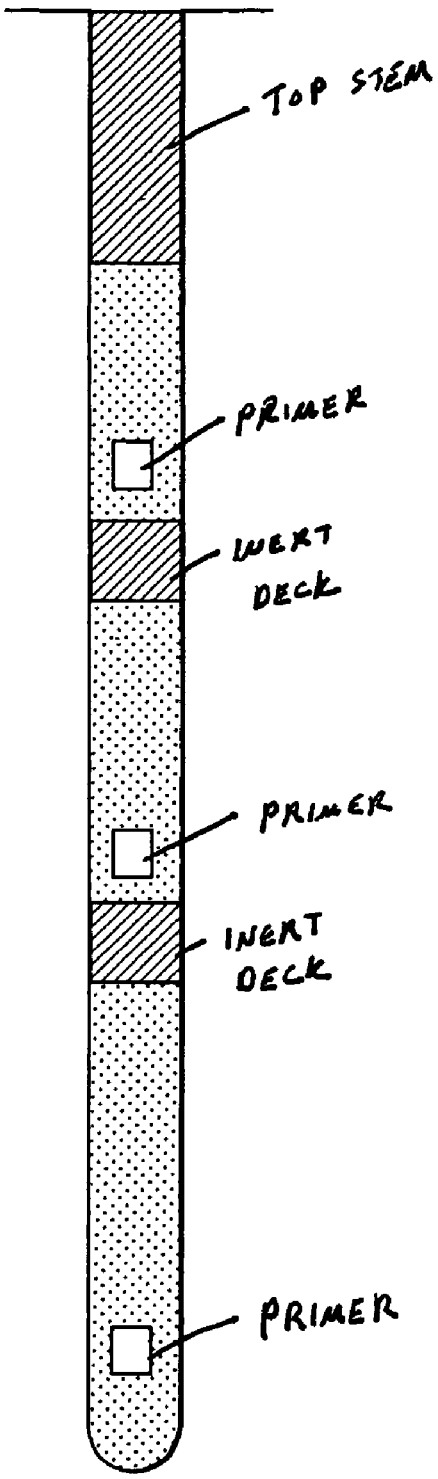
FIG. 3 PRIOR ART
FIG. 3 is a sectional side view of a borehole loaded with explosives using the traditional decking method using dirt or inert material between layers of explosives and primers.
Figure 4:
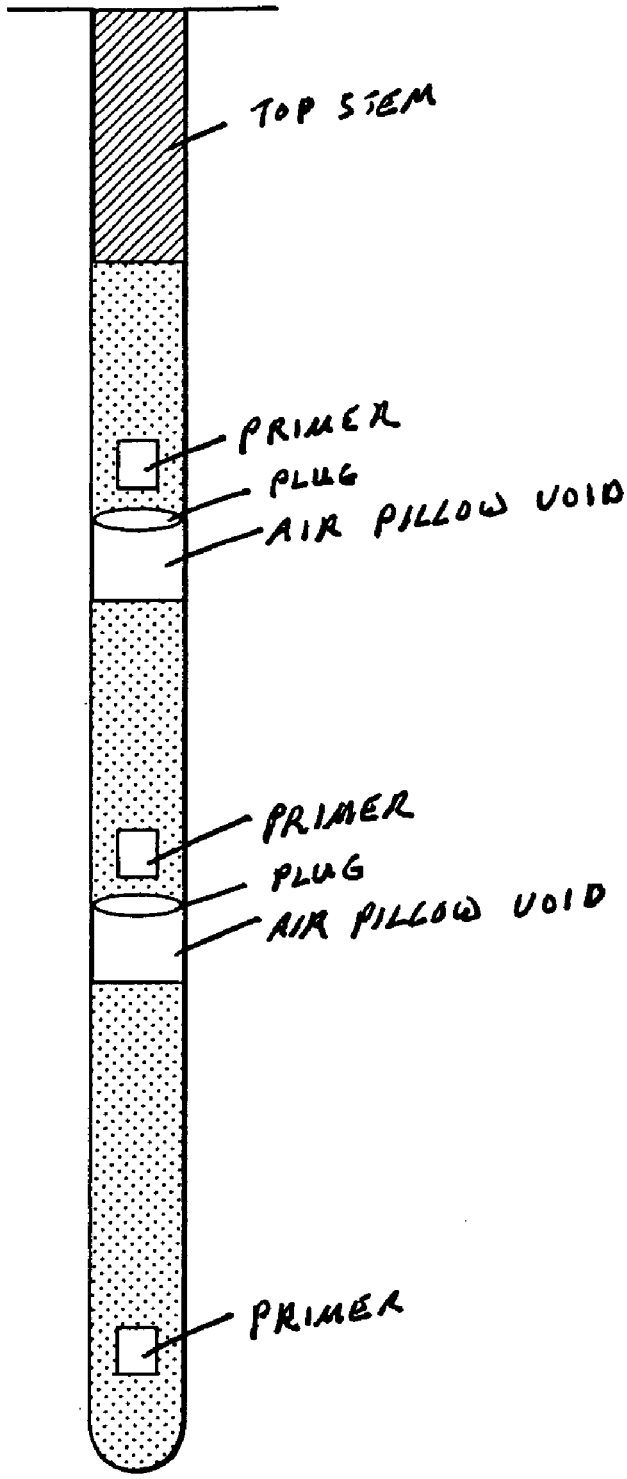
FIG. 4 PRIOR ART
FIG. 4 is a sectional side view of a borehole loaded with explosives using the traditional air gap method wherein air pillows are inserted into the bore hole to create plugs and air filled voids between layers of explosives and primers.
Figure 6:
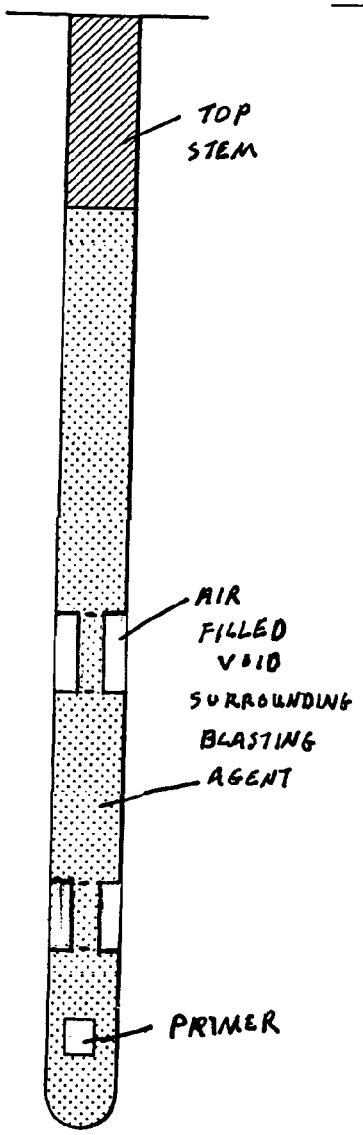
FIG. 6 PRIOR ART
FIG. 6 is a sectional side view of a borehole loaded with explosives using the Wyoming device method wherein spaced apart air filled bags shaped like donuts or cylinders having axial holes there through are dropped at selected points and spaced apart from one another and are surrounded by explosives in layers above and below and are connected by explosives filling the center void of the air filled bags to create air voids within the borehole and forming a continuous column in contact with a single primer.
Figure 5:
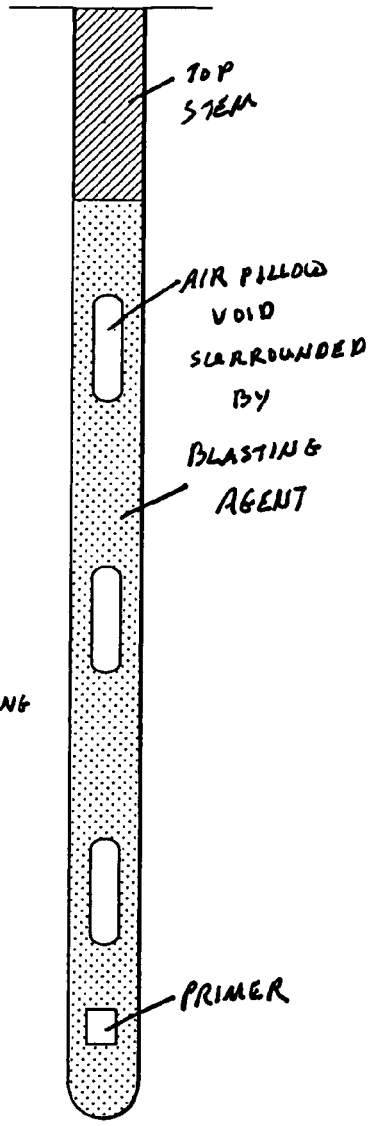
FIG. 5 PRIOR ART
FIG. 5 is a sectional side view of a borehole loaded with explosives using the Axial Air Gap method wherein spaced apart centered air filled bags surrounded by explosives create air voids within the borehole forming stages with the blasting agent or explosives forming a continuous column in contact with a single primer.
Figure 7:
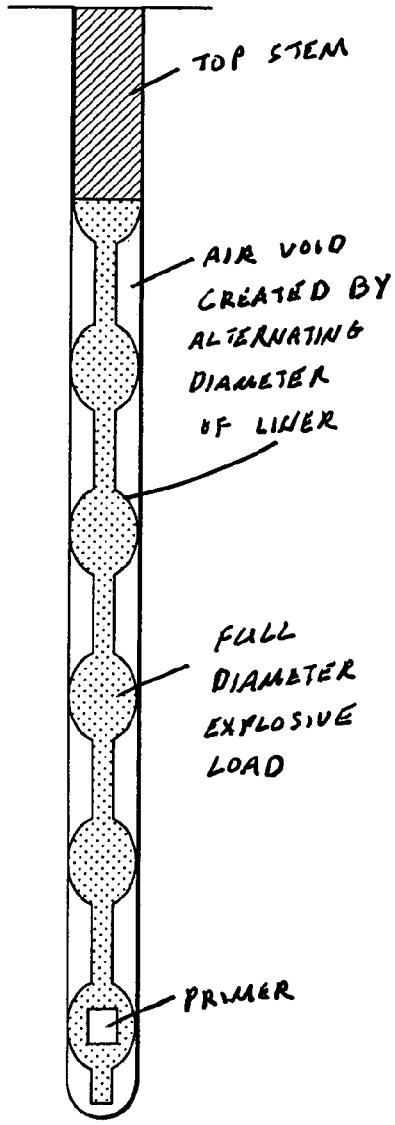
FIG. 7 is a sectional side view of a borehole loaded with explosives using the present invention, the annular air gap method. wherein the air filled voids are formed by the alternating diameter of continuous tube or liner whereby the blasting agent or explosive filles the liner expanding and extending selected alternating portions having to the full diameter of the bore hole and having alternating neck sections filled with the explosives in order to precisely space the blasting agent at selected points between the air voids to increase the force of the explosive charge and with the minimum amount of blasting agent.

The present invention uses historically proven principles of explosive science by maintaining continuous solid columns of explosives in excess of the limits of the critical diameters for ANFO and ANFO-Emulsion blends. The critical minimum diameter for ANFO is 3 inches. The borehole liner is utilized primarily in hole greater than 5 inches in diameter reducing total explosives pounds per hole by 10-20% but only affecting any linear portion of the explosive column by 20% or less. The gap method reduces column loads by 100% in affected areas while the annular gap method reduces column loads in the affected area by from 22 to 40%. Larger diameter holes in the 7 to 12 inch range, have much greater flexibility in that the overall reduction can be attained in fewer feet or averaged over the length of the entire column. Typically the borehole liner will allow the individual blaster to custom order the column reduction to suit the specific needs regarding rock strata, economic goals or environmental concerns. The borehole liner improves on a combination of products and techniques including the air gap and hole liner. The benefits of the borehole liner include: reduced explosives use, reduced NOX emissions, moisture protection for ANFO, sealed or bridged cracks, reduced vibration, and controlled air blast.

The depth of the borehole is determined. Then the placement of the alternating charge weight is calculated to ensure an effective and cost efficient blast. The liner is designed and made to meet those requirements. The liner has varying diameters in order to create the air gap between the liner and the wall of the borehole. Referring to the drawings in detail, reference character generally indicates an elongated drilled borehole drilled into a rock structure which is to be fragmented by an explosive detonation. The liner is inserted into the borehole and weighted with either a rock or small explosive charge and lowered to the bottom of the borehole. The liner can be pulled up from the bottom to stretch it to the performed length providing the selected spacing of the blasting agent. Once the liner is in place the required amount of blasting agent is added.

Uniform spacing of the undulating liner or sleeve completely blocks off a portion of the blast hole. Moreover, there the liner can be sized for small or large diameter holes. The undulating liner provides better distribution of the powder than conventional bore hole air gap filling methods.

The undulated liner can be formed by heat welding sections of a continuous plastic tube providing spaced apart undulations, profile molding as described in U.S. Pat. No. 4,957,687 by Akman et al. or by continuous extrusion as described by U.S. Pat. No. 3,540,094 by Hendrick et al. For example, an undulated liner having a larger diameter portion of about 7 and ⅞ inches to 8 inches may utilize a restricted or reduced diameter section of about 6.9 inches resulting in a 12% savings in blasting agent over a length of about 12 feet while maintaining a consistent volume of detonation.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A blast hole liner assembly system, comprising:

a continuous length of undulating polymeric tube having alternating diameters at selected spaced apart intervals forming a plurality of alternating neck portions and full diameter portions within said blast hole creating air filled voids between an exterior surface of said neck portions of said polymeric tube and a wall of said blast hole;

a blasting agent completely filling said continuous length column of blasting agent;

at least one primer in communication with said blasting agent;

said full diameter portions and said neck portions of said polymeric tube forming alternating axial air gaps minimizing the amount of blasting agent and increasing the force of the explosive charge.

2. The annular air gap blast hole liner system of claim 1, further comprising uniform spacing of said undulating tube.

3. The annular air gap blast hole liner system of claim 1, wherein said full diameter portions completely blocks off a portion of said blast hole.

4. The annular air gap blast hole liner system of claim 1, wherein said annular air gap reduces the vibration.

5. The annular air gap blast hole liner system of claim 1, said polymeric tube providing wet hole protection for said blasting agent.

6. The annular air gap blast hole liner system of claim 1 wherein said blasting agent is ammonium nitrate and fuel oil.

7. The annular air gap blast hole liner system of claim 1 wherein said polymeric tube seals and bridges cracks of said wall of said blast hole conserving said blasting agent.

8. The annular air gap blast hole liner system of claim 1 wherein said blasting agent is selected from the group consisting of a solid chemical compound, a liquid chemical, a gelatin chemical compound, and combinations thereof.

9. The annular air gap blast hole liner system of claim 1 further including stemming inserted on said top of said blasting agent.

* * * * *